US009267322B2

(12) United States Patent
Inui et al.

(10) Patent No.: US 9,267,322 B2
(45) Date of Patent: Feb. 23, 2016

(54) FLAP GATE-TYPE WATERPROOF PANEL FOR WALL INSTALLATION

(75) Inventors: Masaki Inui, Osaka (JP); Yuuichirou Kimura, Osaka (JP); Kyouichi Nakayasu, Osaka (JP); Toshiaki Morii, Osaka (JP); Yoshito Yamakawa, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 14/350,694

(22) PCT Filed: Sep. 7, 2012

(86) PCT No.: PCT/JP2012/072937

§ 371 (c)(1), (2), (4) Date: Apr. 9, 2014

(87) PCT Pub. No.: WO2013/058031

PCT Pub. Date: Apr. 25, 2013

(65) Prior Publication Data

US 2014/0230328 A1 Aug. 21, 2014

(30) Foreign Application Priority Data

Oct. 19, 2011 (JP) ..... 2011-229768

(51) Int. Cl.
*E06B 9/00* (2006.01)
*E02B 7/50* (2006.01)
(Continued)

(52) U.S. Cl.
CPC ... *E06B 9/00* (2013.01); *E02B 7/50* (2013.01); *E06B 5/003* (2013.01); *E06B 9/04* (2013.01);
(Continued)

(58) Field of Classification Search
CPC ..... E02B 7/40; E02B 7/42; E02B 7/44; E02B 7/50; E06B 5/00; E06B 2009/007; E06B 9/00; E06B 9/04; E06B 5/003
USPC ..... 49/10–12, 21; 405/87, 92, 96, 99, 100
See application file for complete search history.

(56) References Cited

U.S. PATENT DOCUMENTS 978,468 A * 12/1910 Merritt ..... 405/95
3,173,269 A * 3/1965 Imbertson ..... 405/87
(Continued)

FOREIGN PATENT DOCUMENTS

AT 11419 U1 * 8/2010
GB 2370597 A * 7/2002
(Continued)

OTHER PUBLICATIONS

International Search Report for International Application No. PCT/JP2012/072937, dated Oct. 9, 2012, 1 page.
(Continued)

*Primary Examiner* — Katherine Mitchell
*Assistant Examiner* — Marcus Menezes
(74) *Attorney, Agent, or Firm* — Brinks Gilson & Lione

(57) ABSTRACT

The present invention utilizes a vertically upward force of a water when a tsunami smashes into a building to close openings that exist in an elevated location such as air supply and exhaust ducts, powerlessly and without a manual operation. The present invention serves as a disaster prevention panel which closes an opening 2*a* disposed in a wall of a building 2. A door bumper 3 is disposed on an outer peripheral wall of the opening 2*a*, and side door bumpers 4 are disposed on both sides of the door bumper 3. A door body 1, which closes the opening 2*a* and which has a specific gravity lower than a seawater, is attached between the side door bumpers 4 on both sides so as to freely swing upwards, with a lower portion of the door bumper 3 serving as a fulcrum.

5 Claims, 4 Drawing Sheets

(51) Int. Cl.

| | |
|---|---|
| ***E06B 5/00*** | (2006.01) |
| ***E06B 9/04*** | (2006.01) |
| *E05F 1/00* | (2006.01) |
| *E05F 1/02* | (2006.01) |
| *E05F 11/04* | (2006.01) |

(52) U.S. Cl.
CPC .. *E05F 1/00* (2013.01); *E05F 1/006* (2013.01); *E05F 1/02* (2013.01); *E05F 11/04* (2013.01); *E06B 2009/007* (2013.01)

(56) References Cited

U.S. PATENT DOCUMENTS

| | | | | | |
|---|---|---|---|---|---|
| 3,316,934 | A * | 5/1967 | Sowers | 137/578 |
| 3,333,423 | A * | 8/1967 | Cook, Jr. | 405/100 |
| 4,253,202 | A * | 3/1981 | Norris | 4/497 |
| 4,549,837 | A * | 10/1985 | Hebert | 405/101 |
| 6,623,209 | B1 * | 9/2003 | Waters, Jr. | 405/94 |
| 7,033,112 | B2 * | 4/2006 | Rijlaarsdam | 405/87 |
| 7,648,310 | B2 * | 1/2010 | Lee et al. | 405/36 |
| 8,366,348 | B2 * | 2/2013 | Morii et al. | 405/100 |
| 2004/0009041 | A1 * | 1/2004 | Aughton et al. | 405/99 |
| 2012/0028564 | A1 * | 2/2012 | Kelly | E04B 1/7076 454/275 |
| 2012/0219360 | A1 * | 8/2012 | Morii et al. | 405/100 |
| 2014/0140770 | A1 * | 5/2014 | Nakayasu et al. | 405/107 |
| 2014/0193202 | A1 * | 7/2014 | Arai et al. | 405/100 |

FOREIGN PATENT DOCUMENTS

| | | | | |
|---|---|---|---|---|
| GB | 2371324 | A * | 7/2002 | E02B 3/10 |
| GB | 2479125 | B * | 6/2012 | |
| JP | 09-209327 | A | 8/1997 | |
| JP | 2001-521089 | A | 11/2001 | |
| JP | 2003-253912 | A | 9/2003 | |
| JP | 2006-299574 | A | 11/2006 | |

OTHER PUBLICATIONS

International Preliminary Report on Patentability, and Transmittal and Translation thereof, in corresponding International Application No. PCT/JP2012/072937, dated May 1, 2014, 6 pages.

* cited by examiner (a)

(b)

FLAP GATE-TYPE WATERPROOF PANEL FOR WALL INSTALLATION

This application is a 371 application of PCT/JP2012/72937 having an international filing date of Sep. 7, 2012, which claims priority to JP 2011-229768 filed Oct. 19, 2011, the entire contents of which are incorporated herein by reference.

TECHNICAL FIELD

The present invention relates to a flap gate-type waterproof panel for a wall installation which closes openings that exist in an elevated location such as air supply and exhaust ducts installed in fixed structures, thus making it possible to prevent an influx of a tsunami, powerlessly and without a manual operation, even if a hood or a ventilation fan is present in the vicinity of the opening.

BACKGROUND ART

In the event that a tsunami smashes into a fixed structure such as a reinforced concrete building (referred to below as a building), there is an influx of water into the building from openings such as windows, doors, air supply and exhaust ducts, and the like, which are positioned lower than the wave height of the tsunami.

In such an event, if the openings are disposed at low elevations such as windows and doors, people who live in the building are able to prevent an influx of water by closing the openings before the tsunami arrives (e.g., Patent Reference 1).

However, if openings such as air supply and exhaust ducts are present in an elevated location, and if an air intake and exhaust system such as a ventilation fan is present in the vicinity of the openings, a mechanism for closing the openings becomes complicated. In addition, it takes time to close the openings manually, and the people involved in the closing operation are exposed to danger. Patent Reference 1: Japanese Patent Publication No. 2001-521089

SUMMARY OF THE INVENTION

Problems to be Solved by the Invention

One problem which the present invention aims to solve is that, in the event that a tsunami smashes into a building, if openings such as air supply and exhaust ducts are located in an elevated position, and if an air intake and exhaust system is present in the vicinity of the openings, a mechanism for closing the openings becomes complicated. Another problem is that it takes time to close the openings manually, and the people involved in the closing operation are exposed to danger.

Means for Solving these Problems

The present invention has as its object to provide a flap gate-type waterproof panel which closes an opening located in an elevated location, as well as an opening where an air intake and exhaust system is present, powerlessly and without manual operation, by utilizing a vertically upward force of a water when a tsunami smashes into a building.

The flap gate-type waterproof panel for wall installation according to the present invention is a disaster prevention panel which closes an opening located in a wall of a building, having as its most essential features:

a door bumper disposed on an outer peripheral wall of the opening, and side door bumpers located on both sides of the door bumper, and a door body which closes the opening and which has a specific gravity lower than a seawater, and which is attached between the side door bumpers on both sides so as to freely swing upwards, with a lower portion of the door bumper serving as a fulcrum.

The present invention is able to prevent an influx of water into a building by closing the openings of the building powerlessly and without manual operation, because the door body swings upwards by utilizing a vertically upward force of the water which smashes into the building.

Advantageous Effects of the Invention

According to the present invention, people living in a building are able to focus on escaping to a higher elevation, because the present invention makes it possible to prevent an influx of water into the building by closing the openings of the building powerlessly and without manual operation. This ensures safety, and also makes it possible to protect assets inside the building from water infiltration resulting from the tsunami.

BRIEF DESCRIPTION OF THE DRAWINGS

FIG. 1 (*a*) is a front view. FIG. 1 (*b*) is a lateral sectional view.

FIG. 3 (*a*) is a lateral sectional view. FIG. 3 (*b*) is a drawing illustrating a mechanism for maintaining a raised position.

DETAILED DESCRIPTION OF THE PREFERRED EMBODIMENTS

The present invention has as its object to close an opening located in an elevated location, as well as an opening where an air intake and exhaust system is present, powerlessly and without manual operation, by utilizing a vertically upward force of a water when a tsunami smashes into a building.

The aforementioned object of the present invention is achieved by attaching a door body having a specific gravity lower than a seawater between side door bumpers provided at an opening so as to freely swing upwards, with a lower portion of a door bumper serving as a fulcrum.

EXAMPLES

Embodiments of the present invention are described in detail below, making use of FIGS. 1-6.

Figure 1:
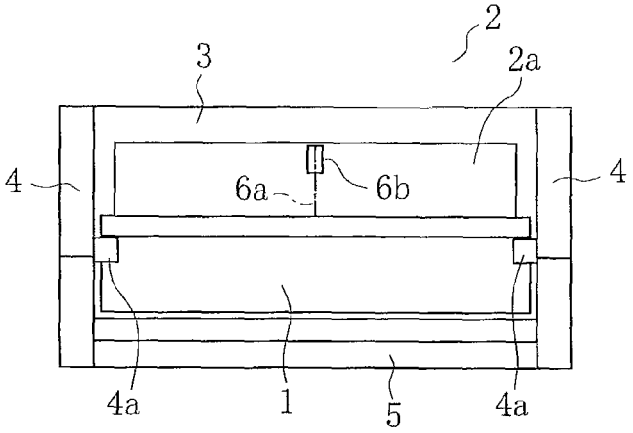
FIGS. 1 (*a*) and (*b*) are drawings illustrating the first example of a flap gate-type waterproof panel for wall installation according to the present invention.
Figure 1:
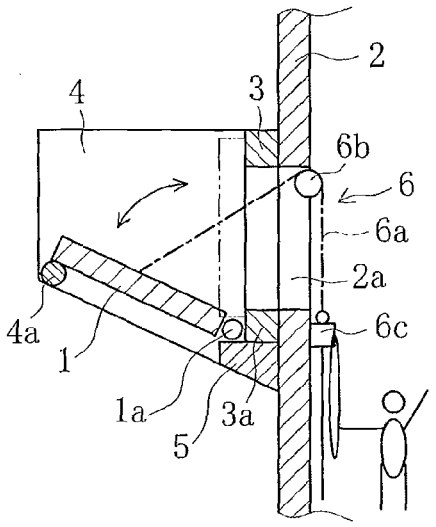

FIG. 1 is a drawing illustrating the first example of a flap gate-type waterproof panel for a wall installation according to the present invention.

The present invention prevents an influx of a tsunami into a building by closing an opening by raising a disaster prevention panel by utilizing the fact that a tsunami which crashes into a building ascends a wall in a vertical direction. An example of the structure of the present invention is shown in FIG. 1.

Reference Numeral 1 is a door body made from a metal such as stainless steel, for example, and is formed with a hollow internal portion so that it has a specific gravity lower than seawater. Since the door body 1 is so formed, it is able to respond, even in a case in which a tsunami does not impact a building 2 from the front and does not ascend a wall of the building 2 in a vertical direction, or even in a case in which a tsunami impacts from the front of the building 2, but lacks sufficient vertical force to ascend the wall of the building 2 and thus a water level gradually rises.

Reference Numeral 3 is a door bumper disposed at an outer peripheral wall on an outer side of an opening 2*a* in a wall of the building 2, and made from a metal or concrete. As needed, a water-tight rubber (not pictured) is attached to the door bumper 3, so that the door bumper 3 will form a water-tight lining which makes contact with the door body 1 when closing the opening 2*a*. At the lower portion of the door bumper 3 there is provided an attaching member 3*a* of a hinge member 1*a* which forms a center point when the door body 1 swings upwards. As needed, a water-tight rubber can be attached to this hinge member 1*a* as well.

In the example shown in FIG. 1, a current rectifier 5 is installed at the lower portion of the door bumper 3. The lower surface of this current rectifier 5 is installed so as to incline in an upward direction at 5-80° from a horizontal plane, in order to reduce an impact of the tsunami which operates on the door body 1. This has the effect of eliminating a vertical impact of the flow of the tsunami on the door body 1, by changing the flow direction of the tsunami ascending the wall from a vertical upward direction to an upstream direction of the tsunami.

Reference Numeral 4 is a side door bumper installed along a side end surface of the door body 1 on both sides of the door bumper 3 to prevent an influx of a tsunami from a side of the door body 1 or an influx of water having a level which is gradually rising. The side door bumper 4 is, for example, made from metal or concrete, like the door bumper 3. As needed, a water-tight rubber (not pictured) can also be attached to a portion of the door body 1 which touches the side door bumper 4.

The lower surface of this side door bumper 4 is also caused to incline in an upward direction at 5-80° from a horizontal plane, in order to reduce an impact of the tsunami. In addition, a receiving member 4*a* is provided on an inner side of the side door bumper 4 to support the door body 1.

It is desirable to have the door body 1 supported by the receiving member 4*a* in a stand-by state such that it inclines in an upward direction at 5-80° from a horizontal plane, so that when a tsunami approaches, it will deflect the flow of the tsunami and reduce the force of its impact. This is because if the flow of the tsunami operates vertically on the door body surface, the force of impact on the door body 1 becomes great, causing the door body 1 to violently swing upwards, damaging it, and there is a risk that the door body 1 will crash against the door bumper 3, resulting in damage to both.

The flap gate-type waterproof panel for wall installation according to the present invention comprises at least the door body 1, the door bumper 3, and the side door bumper 4, but, in the example shown in FIG. 1, a manual opening and closing device 6 is also provided inside the building 2 so that operation of the door body 1 will not be hindered by the tsunami.

This opening and closing device 6 is constructed such that a chain 6*a* has one end attached at a position separated from the hinge member 1*a* of the door body 1 and thus has the other end wound or unwound by using a chain block 6*c* via a sprocket 6*b*. If such an opening and closing device 6 is installed, the door body 1 can be manually opened or closed, if there is leeway in terms of time, and also when operation of the system is being inspected.

Figure 2:
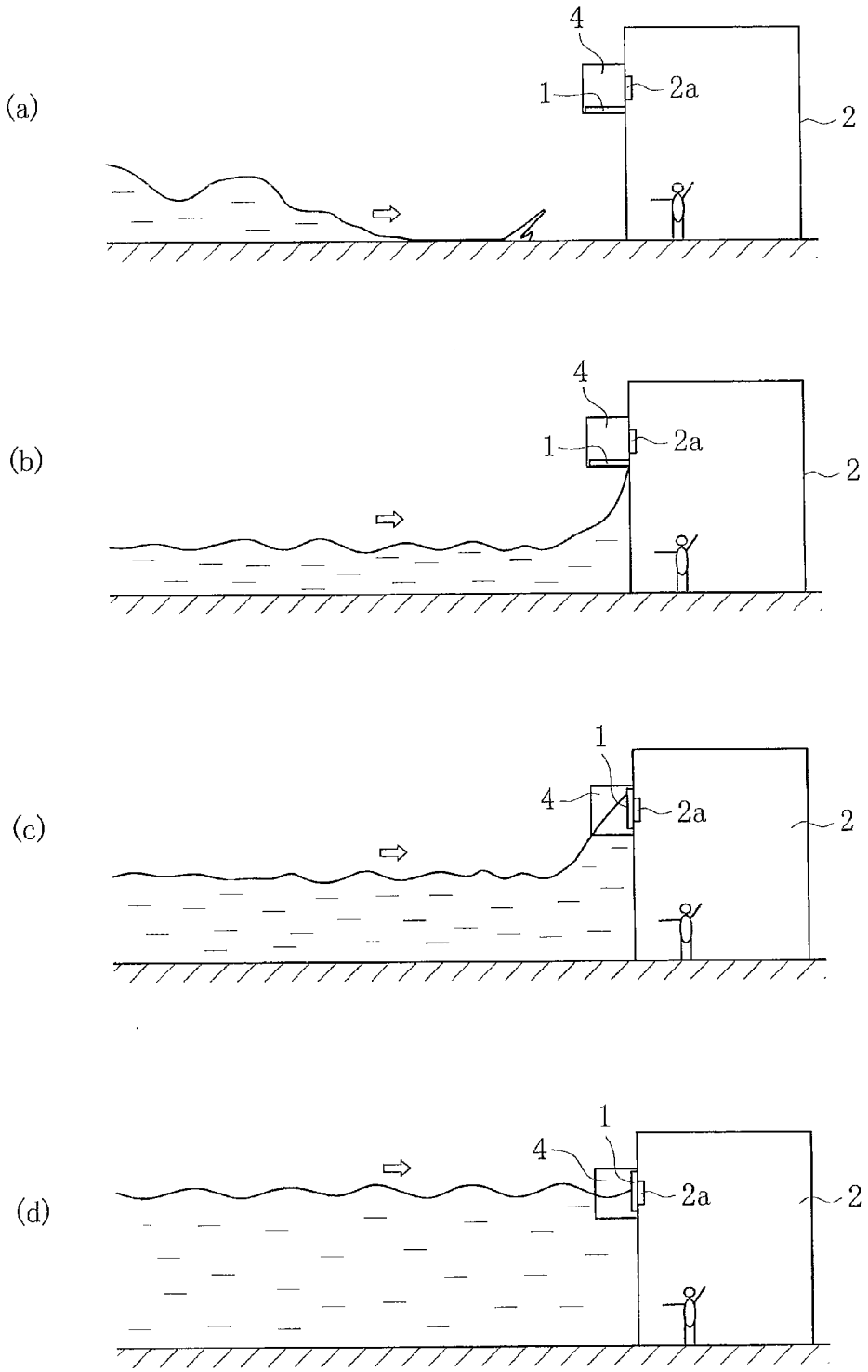
FIGS. 2 (*a*)-(*d*) are drawings illustrating successive stages of closing by a flap gate-type waterproof panel for wall installation according to the present invention.

As shown in FIG. 2, if a disaster prevention panel having the above-described structure according to the present invention is installed in the opening 2*a* of the building 2, when a tsunami approaches (see FIG. 2 (*a*)), the opening 2*a* is closed in a manner described below, thus preventing the tsunami from entering the building.

When a wave height increases because the approaching tsunami smashes against the wall of the building 2 and rebounds (see FIG. 2 (*b*)), the door body 1 is raised powerlessly and without manual operation, utilizing the force of the water ascending the wall (see FIG. 2 (*c*)), thereby closing the opening 2*a* (see FIG. 2 (*d*)).

In a case where a tsunami has no force, but a water level gradually rises so that a surface of the water reaches the opening 2*a*, a buoyancy of the door body 1 causes the door body 1 to rise together with rising water level, powerlessly and without manual operation, closing the opening 2*a* as shown in FIG. 2 (*d*), thus preventing the tsunami from entering the building.

Figure 3:
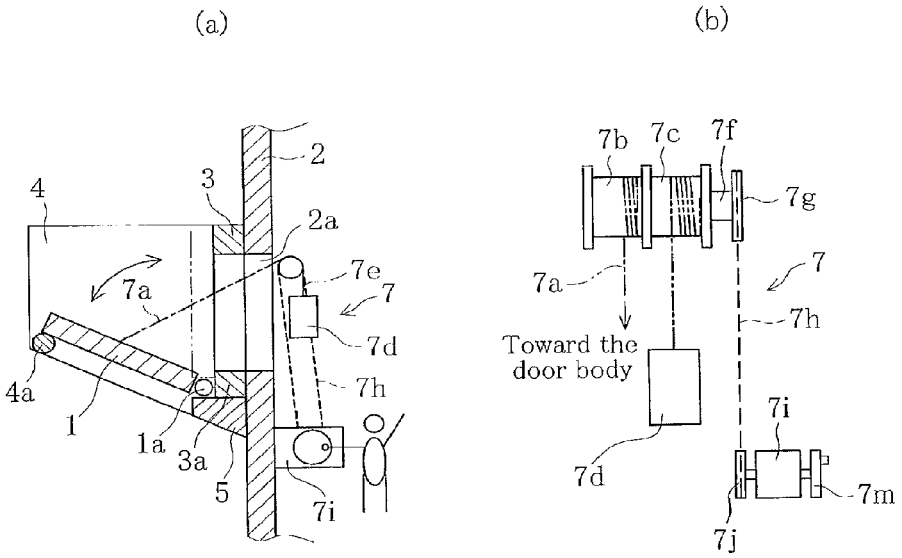
FIGS. 3 (*a*) and (*b*) are drawings illustrating the second example of a flap gate-type waterproof panel for wall installation according to the present invention.

An opening and closing device 7 as shown in FIG. 3 may be used instead of the opening and closing device 6. The opening and closing device 7 has a wire rope 7*a* one end of which is attached at a position separated from the hinge member 1*a* of the door body 1 and the other end of which is wound around a wire drum 7*b*. In addition, one end of a wire rope 7*e* is wrapped around a wire drum 7*c* attached coaxially to the wire drum 7*b*. To the other end of the wire rope 7*e* there is attached a counterweight 7*d* which operates in a direction which raises the door body 1. Moreover, a unidirectional clutch 7*f* which allows rotation of the door body 1 only in the rising direction is attached coaxially to the wire drum 7*c*.

In cases where such an opening and closing device 7 is installed, when the door body 1 starts to rise as the tsunami arrives, the counterweight 7*d* helps the door body 1 to rise, by rotating the wire drums 7*b*, 7*c*, because the counterweight 7*d* operates as an auxiliary force while the door body 1 is rising. When this happens, even if the door body 1 tries to lower, the unidirectional clutch 7*f* prevents the door body 1 from lowering, thus keeping it in a raised position.

In FIG. 3, a sprocket 7*g* is attached coaxially to the unidirectional clutch 7*f*, and a chain 7*h* links the sprocket 7*g* to a sprocket 7*j* which is attached to a decelerator 7*i*. If such a configuration is used, when a handle 7*m* of the decelerator 7*i* is rotated, a rotational force is transmitted via the chain 7*h* to the wire drums 7*c*, 7*b*, thus making it possible to wind the wire rope 7*a*.

The present invention is not limited to the above-described examples, and the embodiment may, of course, be advantageously modified within the scope of the technical ideas recited in the claims.

Figure 4:
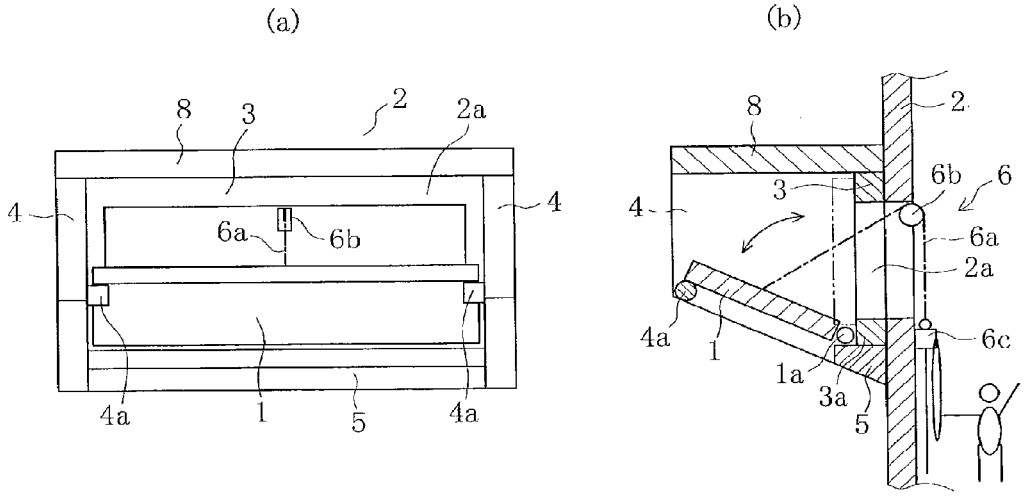
FIGS. 4 (*a*) and (*b*) are drawings illustrating the third example of a flap gate-type waterproof panel for wall installation according to the present invention in a manner similar to FIG. 1.

For example, as shown in FIG. 4, a metal or concrete upper door bumper 8 may be attached to keep rain out. If this upper door bumper 8 is attached, a water-tight rubber may be attached to the front end of the door body 1, as needed, to form a water-tight lining.

Figure 5:
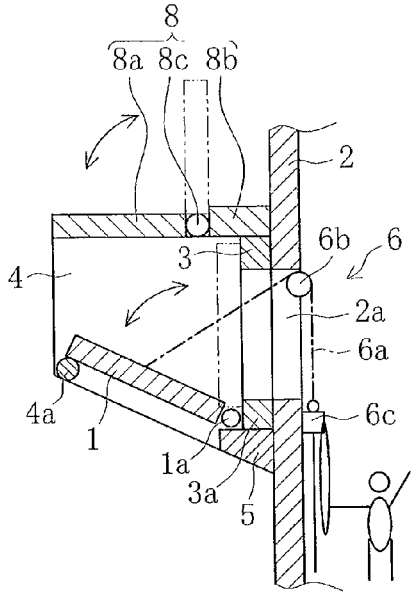
FIG. 5 is a lateral sectional view illustrating the fourth example of a flap gate-type waterproof panel for wall installation according to the present invention.

Since it is anticipated that the upper door bumper 8 will be subjected to the wave force of the tsunami, a front end portion 8*a* and a base end portion 8*b* of the upper door bumper 8 are linked with a hinge 8*c* to form a flap-type member, resulting in a structure which will deflect the tsunami wave force, as shown in FIG. 5.

Figure 6:
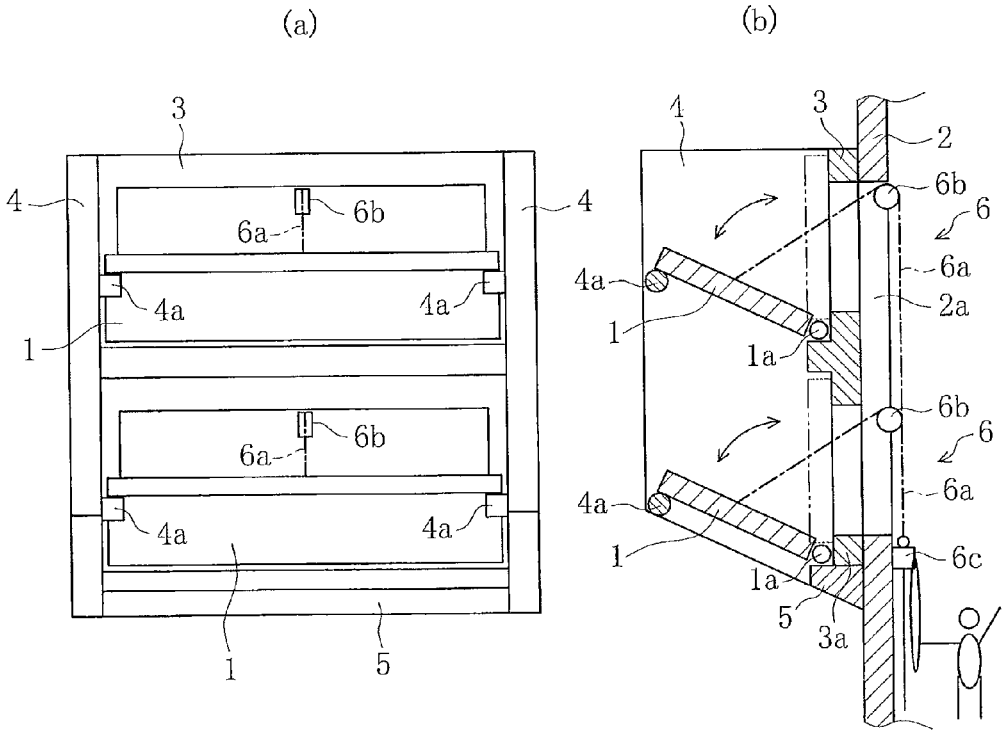
FIGS. 6 (*a*) and (*b*) are drawings illustrating the fifth example of a flap gate-type waterproof panel for wall installation according to the present invention in a manner similar to FIG. 1.

In the examples shown in FIGS. 1, 3, 4, and 5, the opening 2*a* is closed with a single door body 1. However, as shown in FIG. 6, the opening 2*a* may be closed with a plurality of door bodies 1 attached in a height direction (there are 2 door bodies in FIG. 6). If such a configuration is used, the opening 2*a* can be closed while reducing amount of stretching from the wall surface, even if the opening 2*a* is long in the height direction.

The invention claimed is:

1. A flap gate water-resistant panel for wall installation, serving as a disaster prevention panel which closes an opening located in an elevated location of a wall of a building, the panel comprising:

a door bumper disposed on an outer peripheral wall of the opening, and side door bumpers located on opposite sides of the door bumper, a door body which closes the opening and which is attached between the side door bumpers so as to freely swing upwards, wherein a lower portion of the door bumper serves as a fulcrum when the door body swings upward, wherein the door body has first and second ends, wherein the first end is closer to the wall in a stand-by state before engagement with water than the second end, wherein the door body is inclined relative to a horizontal plane in the stand-by state before engagement with water;

a receiving member that supports the second end of the door body in the stand-by state; and a current rectifier installed at the lower portion of the door bumper, wherein when water flows in an initial direction towards the panel, and then vertically upward towards the panel, the current rectifier changes a direction of the water flow from the vertically upward direction to the initial direction.

2. The flap gate water-resistant panel for wall installation according to claim 1, further comprising a wire rope having one end attached to the door body and the other end wound on a wire drum, a counterweight being attached coaxially to the wire drum and operating in a direction which swings the door body upward, and a unidirectional clutch being attached coaxially to the wire drum to allow the door body only to swing upward.

3. The flap gate water-resistant panel for wall installation according to claim 1, wherein the door body is inclined in an upward direction at 5-80° from the horizontal plane in the stand-by state.

4. The flap gate water-resistant panel for wall installation according to claim 1, wherein a plurality of door bodies are attached in a height direction.

5. The flap gate water-resistant panel for wall installation according to claim 3, wherein a plurality of door bodies are attached in a height direction.

* * * * *